United States Patent [19]

Addor

[11] 3,930,427

[45] Jan. 6, 1976

[54] APPARATUS FOR SCREWING AND UNSCREWING THE BOTTOMS OF WATCH CASINGS

[75] Inventor: Rene Addor, Geneva, Switzerland

[73] Assignee: Montres Rolex S.A., Geneva, Switzerland

[22] Filed: Sept. 23, 1974

[21] Appl. No.: 508,559

[30] Foreign Application Priority Data

Sept. 27, 1973 Switzerland ..... 13832/73

[52] U.S. Cl. ..... 81/6

[51] Int. Cl.[2] ..... G04D 1/10

[58] Field of Search ..... 81/6

[56] References Cited

UNITED STATES PATENTS

| | | | |
|---|---|---|---|
| 2,993,394 | 7/1961 | Scott | 81/6 |
| 3,359,839 | 12/1967 | Miller | 81/6 |
| 3,625,093 | 12/1971 | Freiburghaus | 81/6 |

FOREIGN PATENTS OR APPLICATIONS

| | | | |
|---|---|---|---|
| 811,819 | 8/1951 | Germany | 81/6 |

*Primary Examiner*—Al Lawrence Smith
*Assistant Examiner*—Roscoe V. Parker
*Attorney, Agent, or Firm*—St. Onge Mayers Steward & Reens

[57] ABSTRACT

A tool for tightening and untightening screw-type bottoms or backs of watch casings in which the spindle by which the bottom is rotated is threaded to a tool stand using the same pitch of thread as that of the threads on the watchcase bottom, so that as the spindle is rotated it is displaced axially by the same amount as the bottom, thereby keeping the tool on the spindle in proper engagement with the bottom of the case.

2 Claims, 1 Drawing Figure

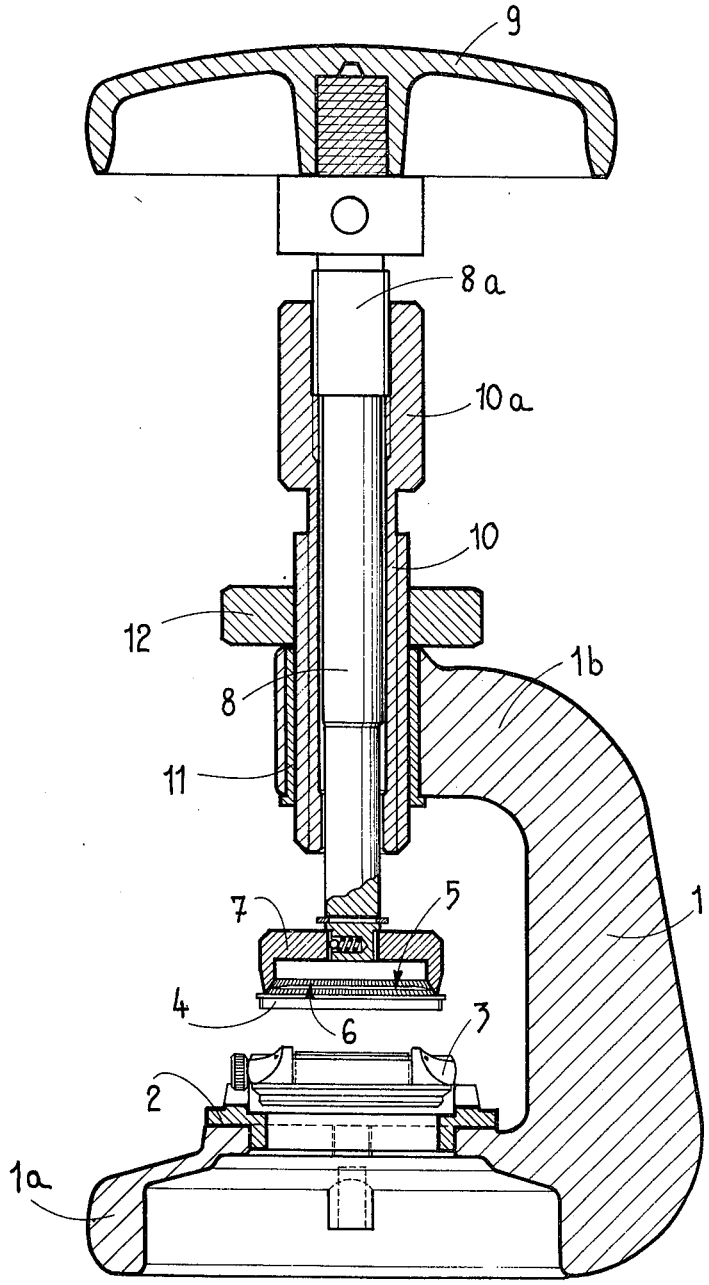
9
8a
10a
10
12
1b
8
11
7
5
1
4
6
3
2
1a

APPARATUS FOR SCREWING AND UNSCREWING THE BOTTOMS OF WATCH CASINGS

BACKGROUND OF THE INVENTION

The present invention relates to an apparatus for screwing and unscrewing the bottoms of watch casings, comprising a stand bearing a rotatable spindle provided with a tool for tightening and untightening watch-case bottoms.

The apparatus of the above mentioned type are known per se. They are generally provided with means, in most of the cases screw means, permitting rapid adjustment in the height of the spindle. However, when the apparatus is in use, the spindle rotates freely in the stand, without effecting any axial movement. The result is that, during the screwing of a bottom of a watch casing, it is necessary, after a certain number of revolutions, to adjust the axial position of the spindle, by means of the rapid adjusting means, otherwise the bottom disengages itself from the tool so that it slips within the tool. Such improper tool engagement results, on the one hand, in failure of the watch-case bottom to be correctly tightened and, on the other hand, gives rise to the danger of damaging the outer surface of the bottom. During the unscrewing of the bottom, it is also necessary to adjust the axial position of the spindle, after a certain number of revolutions, otherwise the bottom moves axially up against the tool and binds against it.

The purpose of the present invention is to remove these drawbacks.

SUMMARY OF THE INVENTION

To this effect, the apparatus according to the invention is characterized by the fact that screw-thread means are provided for at least indirectly threading the spindle in the stand, using threads of the same pitch as those of the watch-case bottom, so that while the bottom is being tightened or untightened, the tool is displaced axially at the same rate that the bottom moves axially, and the tool therefore follows the bottom preventing it from binding or becoming disconnected.

DETAILED DESCRIPTION OF PREFERRED EMBODIMENT

The drawing shows, by way of example, one embodiment of the invention.

The one FIGURE is a sectional view of an apparatus for screwing and unscrewing the bottoms of watch casings.

The apparatus as represented comprises a stand 1 provided with a base 1*a* carrying a fitting 2 intended to receive a watch casing 3 the bottom 4 of which is secured thereto by means of screw-threads. This bottom 4 is provided with a frusto-conical knurled bearing surface 5 with which cooperates a seat 6 of corresponding shape, also knurled, provided on a tool 7. This tool is secured to the end of a spindle 8 provided with a control wheel 9 carried by the arm, designated by 1*b*, of the stand 1.

The spindle 8 is supported within in a sleeve 10 which is screwed, by means of a rapid pitch threading, in a sleeve 11 forced in the arm 1*b* of the stand 1. A counternut 12 locks the sleeve 10 in position. This arrangement permits a rapid adjustment of the height of the spindle 8.

In the apparatus of this type known up to now, the spindle is mounted so that it rotates freely in a sleeve without axial displacement of the spindle with respect to the sleeve.

In the present apparatus, on the contrary, the spindle 8 is not only rotatably mounted in the sleeve 10 but can also move itself axially in this sleeve and to this end, the spindle is provided with a threaded portion 8*a* screwed in a tap provided in the upper portion, designated by 10*a*, of the sleeve 10. The pitch of the threads 8*a* of the spindle is the same as that of the bottom 4. The result is that, when the bottom 4 is screwed on the casing 3 or, on the contrary, is unscrewed therefrom, the spindle 8 and, consequently, the tool 7, while moving axially at the same time as the bottom 4, follows the bottom, in one sense or in the other, without there being any risk that the bottom will escape from the tool or, on the contrary, will bind therein.

What I claim is:

1. In apparatus for tightening and untightening screw-type bottoms of watch casings wherein the threads by which the bottom is attached to its casing have a predetermined pitch, said apparatus including a stand for supporting a watch casing and a spindle rotatable about an axis, together with a tool on said spindle for rotating the bottom of said watch casing, the improvement comprising in combination therewith, screw-thread means for mounting said spindle on said stand for axial movement relative thereto, the threads of said screw-thread means having the same pitch as the threads of the watch-case bottom to be rotated, such that during tightening or untightening of said bottom said tool is displaced axially by an amount equal to the axial displacement of the watch-case bottom whereby said tool follows said bottom.

2. The improvement defined in claim 1, wherein said screw-thread means comprises a sleeve to which said spindle is threaded, said sleeve being also threaded to said stand by means of threads having a rapid pitch in order to provide rapid axial adjustment of said tool into and out of engagement with the bottom of the watch casing.

* * * * *